US009188330B1

(12) United States Patent
Swanson et al.

(10) Patent No.: US 9,188,330 B1
(45) Date of Patent: Nov. 17, 2015

(54) APPARATUS AND METHOD FOR MIXING TUBE ASSEMBLY

(75) Inventors: Malcolm Swanson, Chickamauga, GA (US); Andrew Hobbs, Sheffield (GB); Shannon Putman, Rossville, GA (US); Joseph Unjakoti, Rock Spring, GA (US); Eric Wattenbarger, Attalla, AL (US); Michael Swanson, Chickamauga, GA (US)

(73) Assignee: Astec, Inc., Chattanooga, TN (US)

( * ) Notice: Subject to any disclaimer, the term of this patent is extended or adjusted under 35 U.S.C. 154(b) by 0 days.

(21) Appl. No.: 13/422,228

(22) Filed: Mar. 16, 2012

Related U.S. Application Data

(60) Provisional application No. 61/465,215, filed on Mar. 16, 2011.

(51) Int. Cl.
*F23M 3/00* (2006.01)
*F23C 7/00* (2006.01)

(52) U.S. Cl.
CPC *F23C 7/002* (2013.01); *F23C 7/004* (2013.01)

(58) Field of Classification Search
CPC ..... F23C 7/002; F23C 7/004
USPC ..... 431/8, 9
See application file for complete search history.

(56) References Cited

U.S. PATENT DOCUMENTS

| | | | | |
|---|---|---|---|---|
| 3,811,816 | A * | 5/1974 | Whitman | 431/75 |
| 3,869,244 | A * | 3/1975 | Von Linde et al. | 431/116 |
| 7,785,100 | B1 * | 8/2010 | Swanson et al. | 431/181 |
| 8,113,821 | B2 * | 2/2012 | Feese et al. | 431/9 |

FOREIGN PATENT DOCUMENTS

CA 2260636 A1 * 8/1999

* cited by examiner

*Primary Examiner* — Kenneth Rinehart
*Assistant Examiner* — Gajanan M Prabhu
(74) *Attorney, Agent, or Firm* — Chambliss, Bahner & Stophel, P.C.

(57) ABSTRACT

A mixing tube assembly having an inlet end and an outlet end and being adapted for use in a burner assembly. The mixing tube assembly comprises a substantially cylindrical outer wall which defines an interior open space. The mixing tube assembly also comprises a turbulator that is disposed in the interior open space defined by the substantially cylindrical outer wall. A method for mixing fuel and air in a burner assembly comprising providing a mixing tube assembly. The preferred method also comprises conveying fuel and air from the inlet end of the mixing tube assembly to the outlet end of the mixing tube assembly.

15 Claims, 8 Drawing Sheets

APPARATUS AND METHOD FOR MIXING TUBE ASSEMBLY

CROSS-REFERENCES TO RELATED APPLICATIONS/PATENTS

This application relates back to and claims priority from U.S. Provisional Application for Patent No. 61/465,215 titled "Apparatus and Method for Mixing Tube With a Swirler" and filed on Mar. 16, 2011.

FIELD OF THE INVENTION

The present invention relates generally to burner assemblies, and particularly to devices adapted to mix air and fuel in burner assemblies.

BACKGROUND AND DESCRIPTION OF THE PRIOR ART

It is known to mix air and fuel in burner assemblies. Conventional devices used to mix air and fuel in burner assemblies, however, suffer from one or more disadvantages. For example, conventional devices used to mix air and fuel in burner assemblies are undesirably large and expensive to manufacture and operate. In addition, conventional devices used to mix air and fuel do not efficiently or sufficiently mix air and fuel together.

It would be desirable, therefore, if an apparatus and method for a device adapted to mix air and fuel in a burner assembly could be provided that would reduce the size and cost of manufacture and operation. In addition, it would also be desirable if such an apparatus and method could be provided that would mix air and fuel more efficiently, completely and uniformly.

Advantages of the Preferred Embodiments of the Invention

Accordingly, it is an advantage of the preferred embodiments of the invention claimed herein to provide an apparatus and method for a device adapted to mix air and fuel in a burner assembly that reduces the size and cost of manufacture and operation. It is also an advantage of the preferred embodiments of the invention claimed herein to provide an apparatus and method that mixes air and fuel more efficiently, completely and uniformly.

Additional advantages of the preferred embodiments of the invention will become apparent from an examination of the drawings and the ensuing description.

EXPLANATION OF TECHNICAL TERMS

As used herein, the term "turbulator" means swirlers, curved vanes, bluff bodies, tabs, lips, surface treatments and/or any other suitable device, mechanism, assembly or combination thereof which is adapted to mix fuel and air.

SUMMARY OF THE INVENTION

The apparatus of the invention comprises a mixing tube assembly having an inlet end and an outlet end and being adapted for use in a burner assembly. The mixing tube assembly comprises a substantially cylindrical outer wall which defines an interior open space. The mixing tube assembly also comprises a turbulator that is disposed in the interior open space defined by the substantially cylindrical outer wall.

The method of the invention comprises a method for mixing fuel and air in a burner assembly. The preferred method comprises providing a mixing tube assembly having an inlet end and an outlet end. The preferred mixing tube assembly comprises a substantially cylindrical outer wall that defines an interior open space. The preferred mixing tube assembly also comprises a turbulator that is disposed in the interior open space defined by the substantially cylindrical outer wall. The preferred method also comprises conveying fuel and air from the inlet end of the mixing tube assembly to the outlet end of the mixing tube assembly.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
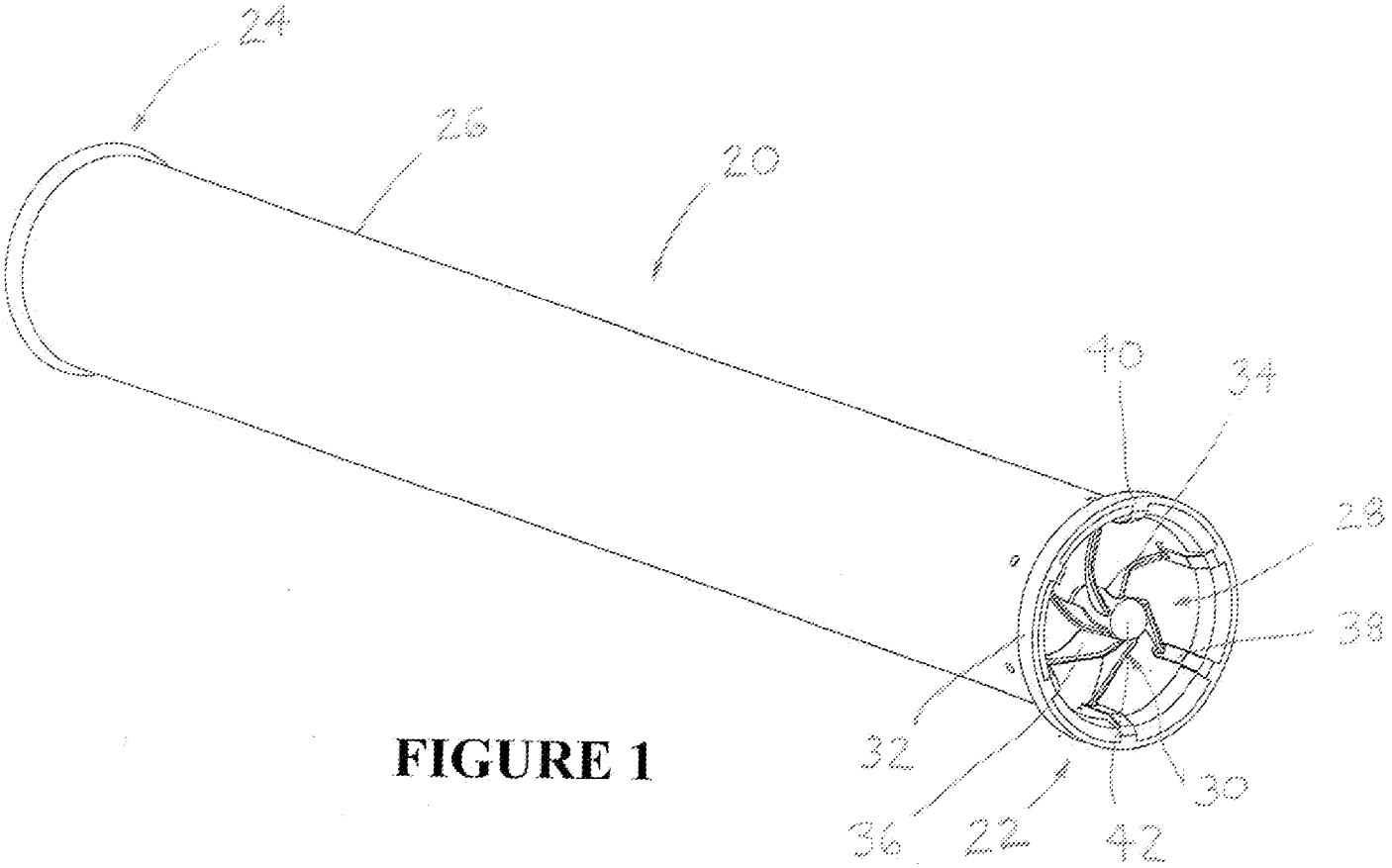
FIG. 1 is a perspective view of the preferred mixing tube assembly in accordance with the present invention.

Referring now to the drawings, the preferred embodiment of the apparatus and method for a mixing tube assembly in accordance with the present invention is illustrated by FIGS. 1 through 6 and 8 through 9. As shown in FIGS. 1-9, the preferred embodiments of the apparatus and method for a mixing tube assembly are adapted to mix air and fuel in a burner assembly that reduces the size and cost of manufacture and operation. The preferred embodiments of the apparatus and method for a mixing tube assembly are also adapted to mix air and fuel more efficiently, completely and uniformly.

Referring now to FIG. 1, a perspective view of the preferred mixing tube assembly in accordance with the present invention is illustrated. As shown in FIG. 1, the preferred mixing tube assembly is designated generally by reference numeral 20. Preferred mixing tube assembly 20 has inlet end 22 and outlet end 24. Preferred mixing tube assembly 20 is adapted for use in a burner assembly such as a gaseous burner assembly, however, it is contemplated within the scope of the invention that the mixing tube assembly could be adapted for use in other suitable items of equipment or applications. Preferred mixing tube assembly 20 comprises substantially cylindrical outer wall 26 which defines interior open space 28. Preferred mixing tube assembly 20 further comprises turbulator 30. Preferred turbulator 30 is disposed in interior open space 28 defined by substantially cylindrical outer wall 26.

Still referring to FIG. 1, preferred substantially cylindrical outer wall 26 of mixing tube assembly 20 includes inlet end flare 32. Preferred inlet end flare 32 of substantially cylindrical outer wall 26 is disposed at inlet end 22 of mixing tube assembly 20. Preferred turbulator 30 is disposed in inlet end 22 of mixing tube assembly 20. Further, preferred turbulator 30 comprises swirler 34. Preferred swirler 34 is disposed in inlet end flare 32 of substantially cylindrical outer wall 26 and comprises plurality of curved vanes 36. Preferably, swirler 34 is attached to plurality of tabs 38. Preferred plurality of tabs 38 are disposed in inlet end 22 of mixing tube assembly 20 and attached to retainer ring 40 which is also disposed in the inlet end of the mixing tube assembly. Preferred turbulator 30 also comprises bluff body 42. Preferred bluff body 42 is spaced apart from substantially cylindrical outer wall 26 and disposed in inlet end 22 of mixing tube assembly 20. Preferred bluff body 42 is also attached to swirler 34, however, it is contemplated within the scope of the invention that the bluff body is not attached to the swirler.

Figure 2:
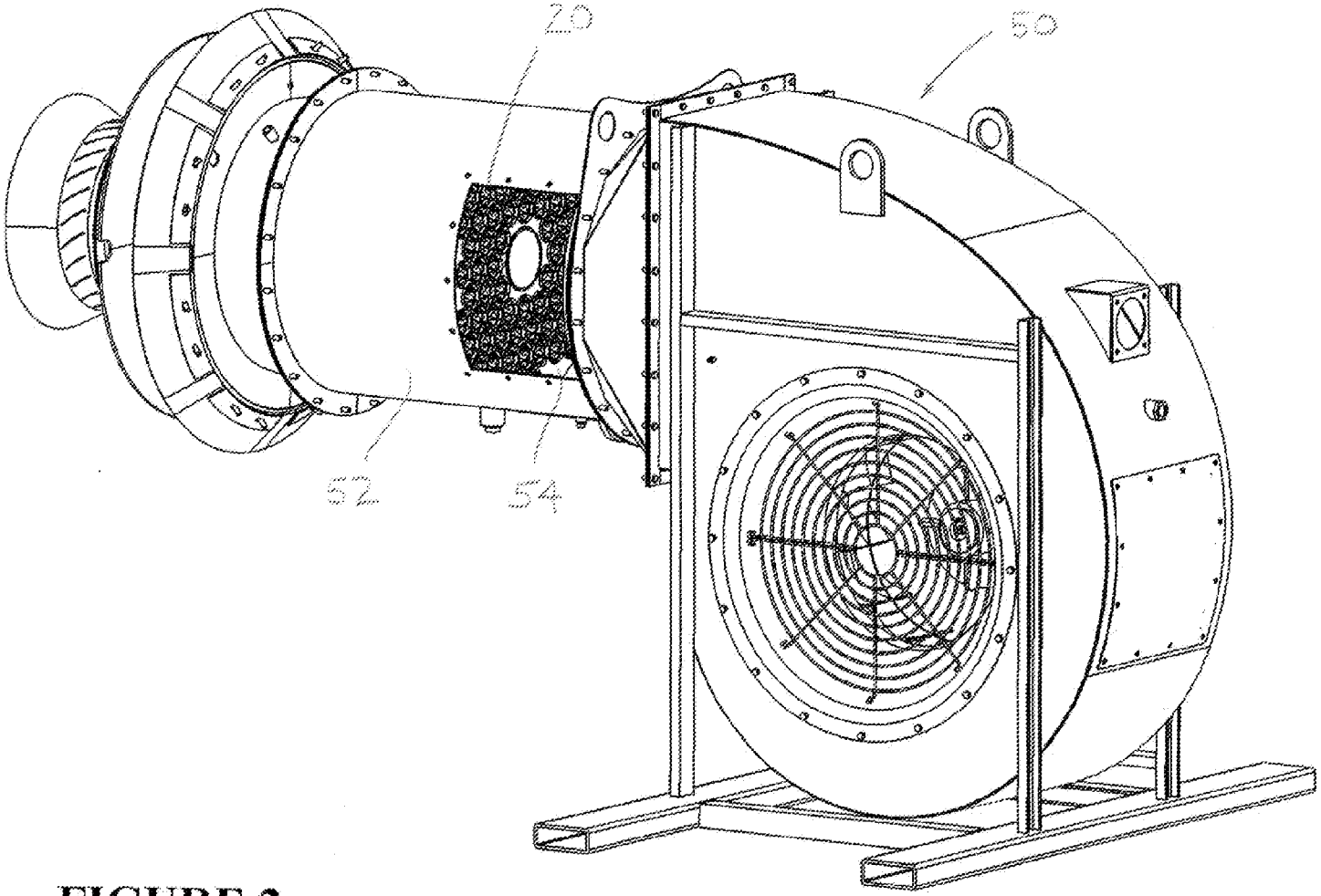
FIG. 2 is a partial sectional perspective view of an exemplary burner assembly including a plurality of the preferred mixing tube assemblies illustrated in FIG. 1.

Referring now to FIG. 2, a partial sectional perspective view of exemplary burner assembly 50 including a plurality of preferred mixing tube assemblies 20 is illustrated. As shown in FIG. 2, the preferred plurality of mixing tube assemblies 20 are disposed in mixing section 52 of burner assembly 50. Preferred mixing section 52 further comprises inlet end tube sheet 54. While preferred mixing section 52 comprises a plurality of mixing tube assemblies 20, it is contemplated within the scope of the invention that mixing section 52 comprises only one mixing tube assembly.

Figure 3:
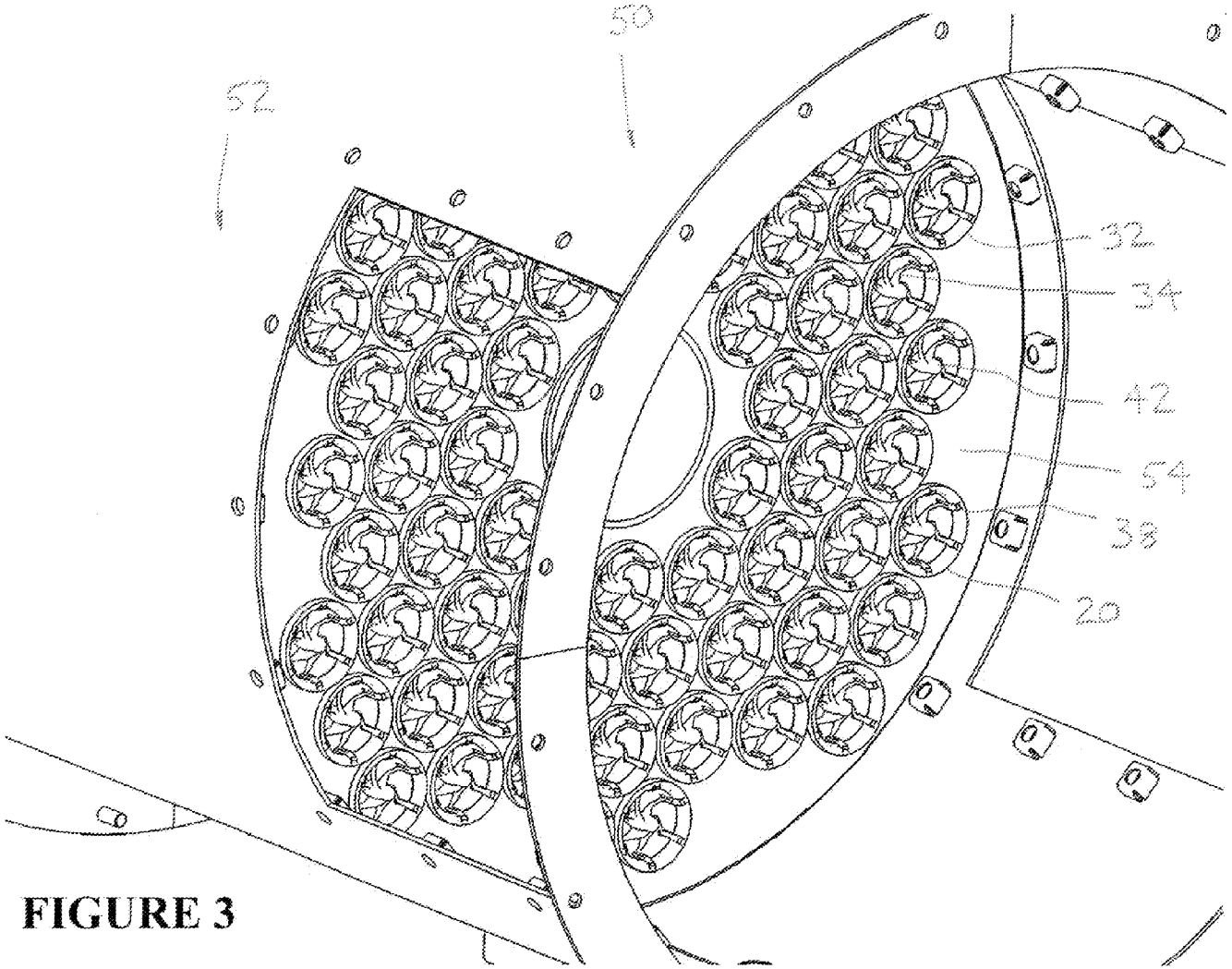
FIG. 3 is a partial sectional perspective view of the exemplary burner assembly including a plurality of the preferred mixing tube assemblies illustrated in FIGS. 1 and 2.

Referring now to FIG. 3, a partial sectional perspective view of exemplary burner assembly 50 including a plurality of preferred mixing tube assemblies 20 is illustrated. As shown in FIG. 3, preferred mixing section 52 comprises inlet end flare 32, swirler 34, tabs 38, bluff body 42 and inlet end tube sheet 54.

Figure 4:
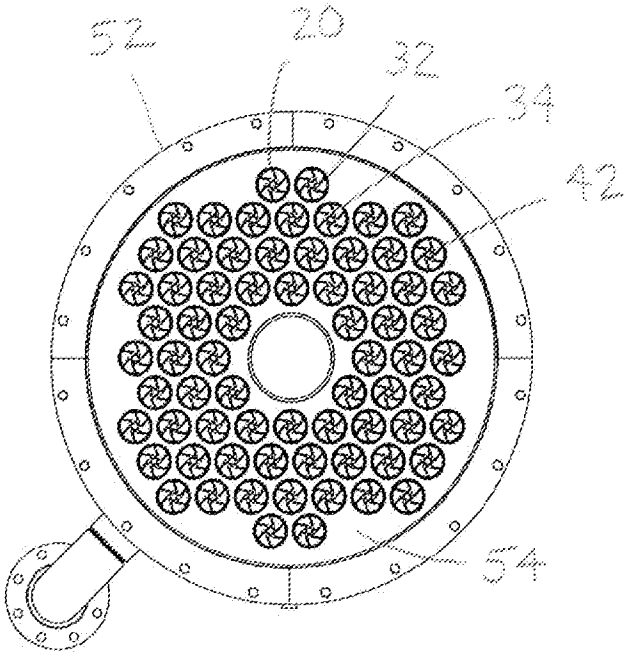
FIG. 4 is an end view of the exemplary mixing section including a plurality of the preferred mixing tube assemblies illustrated in FIGS. 1 through 3.

Referring now to FIG. 4, an end view of exemplary mixing section 52 including a plurality of the preferred mixing tube assemblies 20 is illustrated. As shown in FIG. 4, preferred mixing section 52 includes inlet end flare 32, swirler 34, bluff body 42 and inlet end tube sheet 54.

Figure 5:
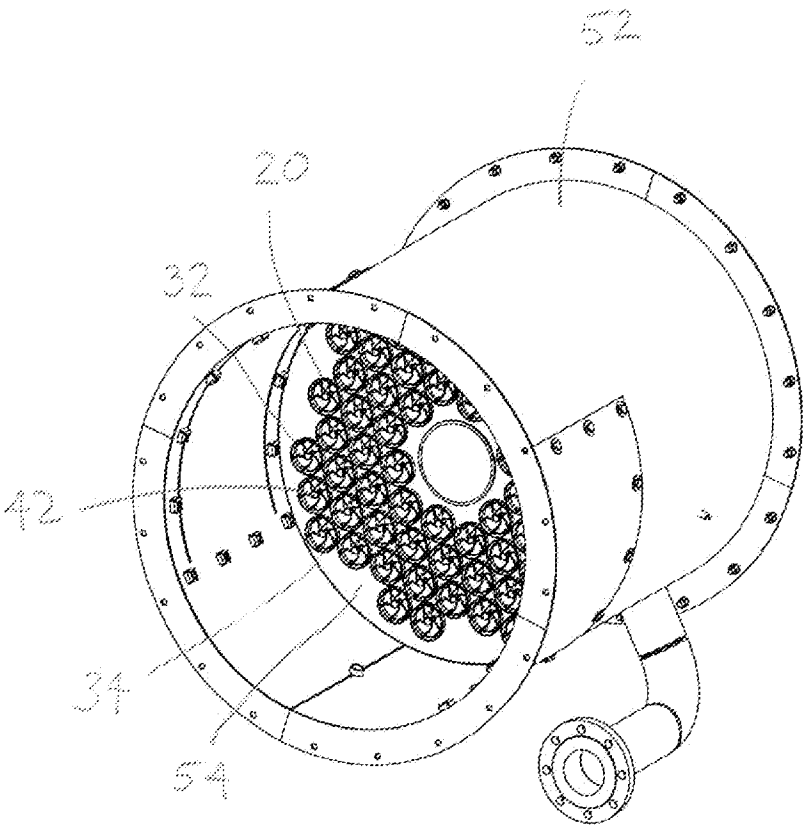
FIG. 5 is a perspective view of the exemplary mixing section including a plurality of the preferred mixing tube assemblies illustrated in FIGS. 1 through 4.

Referring now to FIG. 5, a perspective view of exemplary mixing section 52 including a plurality of the preferred mixing tube assemblies 20 is illustrated. As shown in FIG. 5, preferred mixing section 52 includes inlet end flare 32, swirler 34, bluff body 42 and inlet end tube sheet 54.

Figure 6:
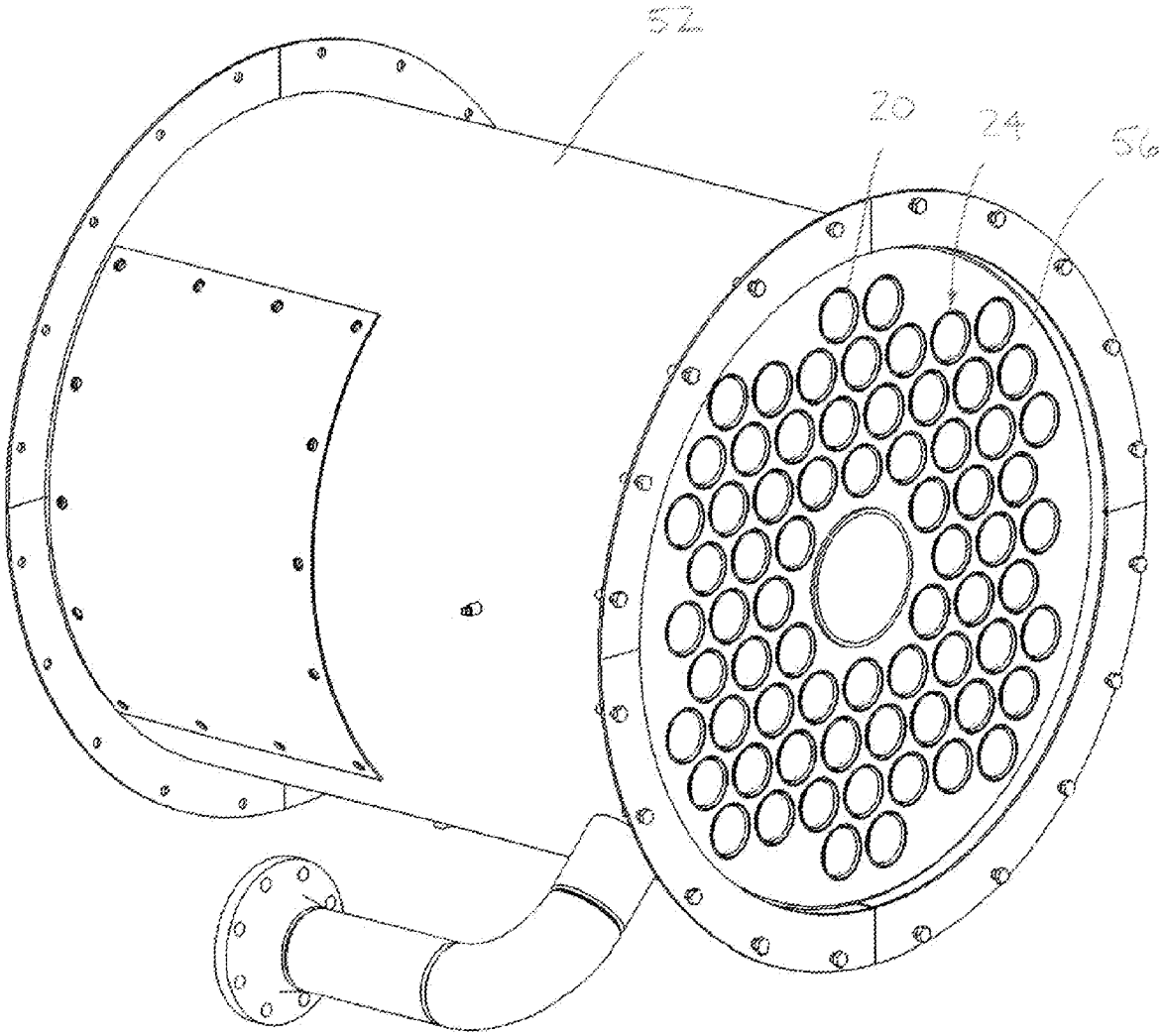
FIG. 6 is a perspective view of the exemplary mixing section including a plurality of the preferred mixing tube assemblies illustrated in FIGS. 1 through 5.

Referring now to FIG. 6, a perspective view of exemplary mixing section 52 including a plurality of the preferred mixing tube assemblies 20 is illustrated. As shown in FIG. 6, preferred mixing section 52 includes outlet end 24 of mixing tube assemblies 20 and outlet end tube sheet 56.

Figure 7:
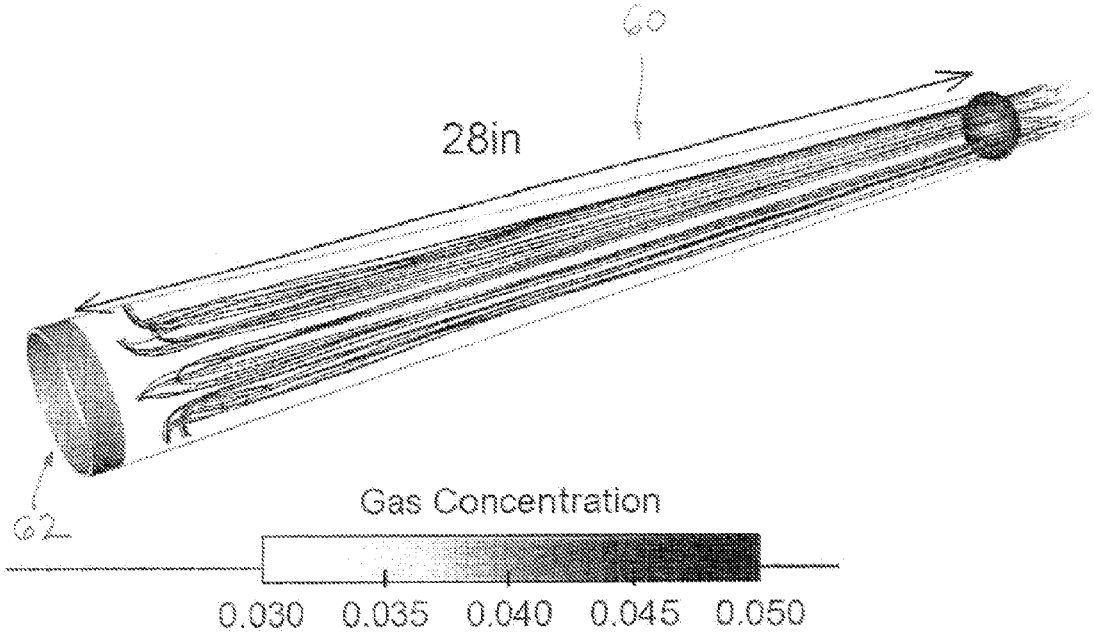
FIG. 7 is a perspective view of a conventional mixing tube showing the concentration of gaseous fuel across a cross-sectional plane 28 inches downstream from the inlet end.

Referring now to FIG. 7, a perspective view of a conventional mixing tube showing the concentration of gaseous fuel across a cross-sectional plane 28 inches downstream from inlet end 62 is illustrated. As shown in FIG. 7, the conventional mixing tube is designated generally by reference numeral 60. Conventional mixing tube 60 causes the concentration of gaseous fuel within the tube to increase near the outer wall and to decrease near the center of the tube.

Figure 8:
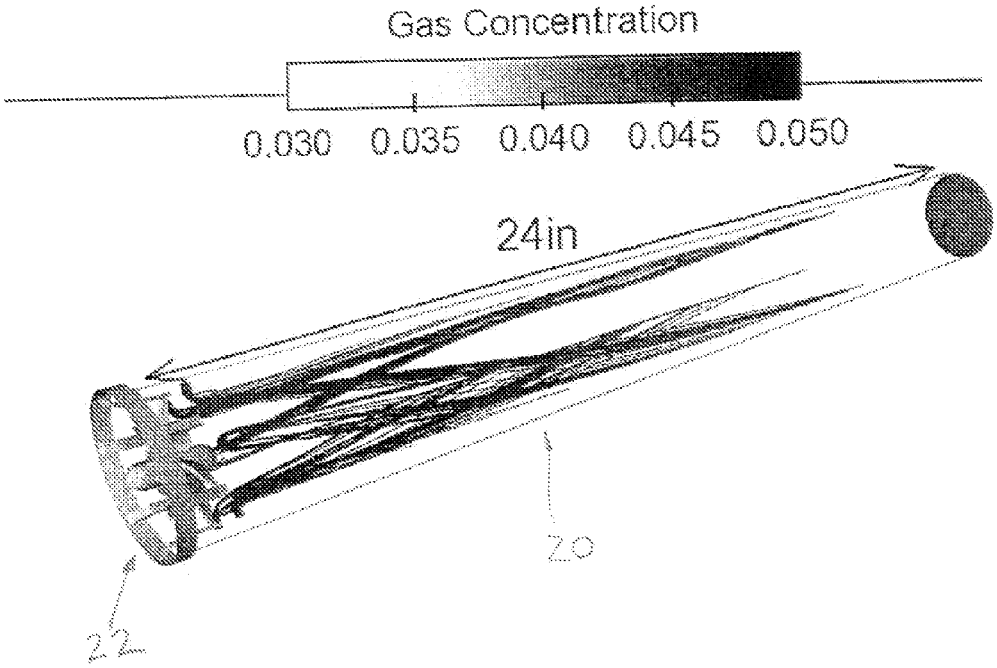
FIG. 8 is a perspective view of the preferred mixing tube assembly illustrated in FIGS. 1-6 showing the concentration of gaseous fuel across a cross-sectional plane 24 inches downstream from the inlet end.

Referring now to FIG. 8, a perspective view of preferred mixing tube assembly 20 showing the concentration of gaseous fuel across a cross-sectional plane 24 inches downstream from inlet end 22 is illustrated. As shown in FIG. 8, preferred mixing tube assembly 20 causes the concentration of gaseous fuel within the tube to more uniform and in a shorter distance than conventional mixing tube 60.

Figure 9:
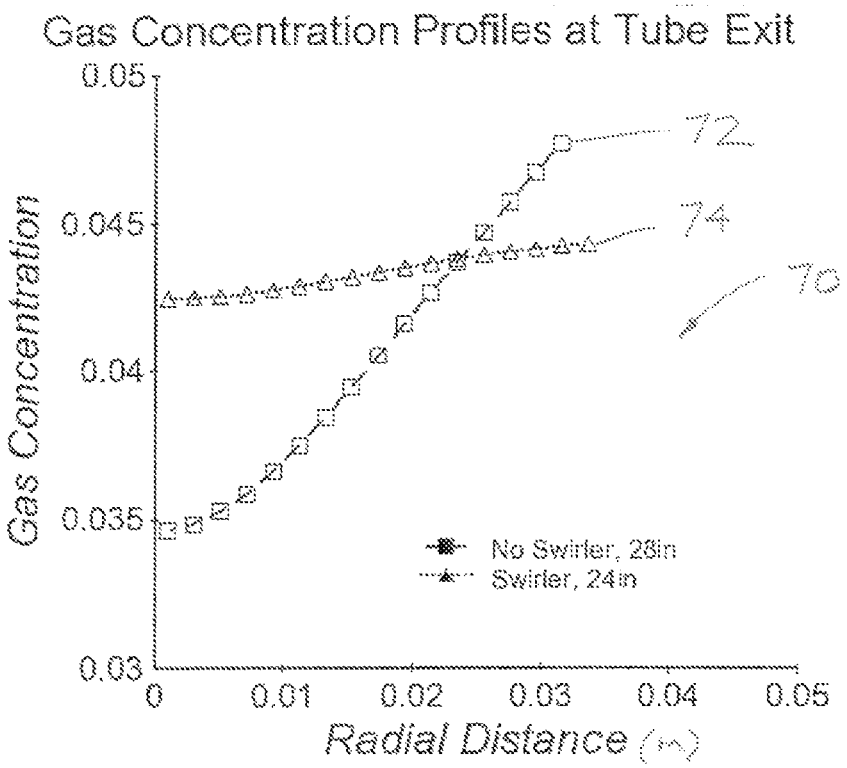
FIG. 9 is a chart illustrating the concentration of gaseous fuel at different radial distances for a conventional mixing tube and the preferred mixing tube assembly illustrated in FIGS. 1-6 and 8.

Referring now to FIG. 9, a chart illustrating the concentration of gaseous fuel at different radial distances for conventional mixing tube 60 and the preferred mixing tube assembly 20 is illustrated. As shown in FIG. 9, the chart is generally designated by reference numeral 70. As shown in chart 70, points 72 represent the gas concentration at different radial distances in conventional mixing tube 60 and points 74 represent the gas concentration at different radial distances in preferred mixing tube 20. More particularly, chart 70 illustrates the mass fraction of methane at radial units (meters) at 28 inches downstream from inlet end 62 of conventional mixing tube 60 and at 24 inches downstream from inlet end 22 of preferred mixing tube assembly 20.

The invention also comprises a method for mixing fuel and air in a burner assembly. The preferred method comprises providing a mixing tube assembly having an inlet end and an outlet end. The preferred mixing tube assembly comprises a substantially cylindrical outer wall which defines an interior open space. The preferred mixing tube assembly also comprises a turbulator that is disposed in the interior open space defined by the substantially cylindrical outer wall. The preferred method also comprises conveying fuel and air from the inlet end of the mixing tube assembly to the outlet end of the mixing tube assembly.

In another preferred embodiment, the method comprises a turbulator having a retainer ring that is disposed at the inlet end of the mixing tube assembly, a plurality of tabs that are attached to the retainer ring, a swirler that is attached to the plurality of tabs and a bluff body that is attached to the swirler. In still another preferred embodiment, the method comprises mixing gaseous fuel and air in the mixing tube assembly.

In operation, several advantages of the preferred embodiments of the invention are achieved. For example, the preferred embodiments of the apparatus and method for a mixing tube assembly are adapted to mix air and fuel in a burner assembly that reduces the size and cost of manufacture and operation. The preferred embodiments of the apparatus and method for a mixing tube assembly are also adapted to mix air and fuel more efficiently, completely and uniformly.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A mixing section adapted for use in a burner assembly, said mixing section comprising a plurality of mixing tube assemblies, each of said mixing tube assemblies having an inlet end and an outlet end and comprising:

(a) a substantially cylindrical outer wall, said substantially cylindrical outer wall defining an interior open space;

(b) a turbulator, said turbulator being disposed in the interior open space defined by the substantially cylindrical outer wall;

wherein each turbulator is substantially surrounded by one substantially cylindrical outer wall and each substantially cylindrical outer wall substantially surrounds one turbulator; and wherein each mixing tube assembly is adapted to receive fuel downstream from the turbulator; and wherein each of the plurality of mixing tube assemblies separately mixes an amount of fuel and air; and wherein the mixing section is adapted to produce a mixture of fuel and air; and wherein at least one of the turbulators comprises a swirler; and wherein the swirler comprises a plurality of curved vanes.

2. The mixing section of claim 1 wherein each of the substantially cylindrical outer walls has an inlet end flare.

3. The mixing section of claim 2 wherein each of the inlet end flares of each of the substantially cylindrical outer walls is disposed at the inlet end of one of the plurality of mixing tube assemblies.

4. The mixing section of claim 1 wherein each of the turbulators is disposed in the inlet end of one of the plurality of mixing tube assemblies.

5. The mixing section of claim 1 wherein the swirler is disposed in the inlet end of at least one of the plurality of mixing tube assemblies.

6. The mixing section of claim 1 wherein the swirler is attached to a plurality of tabs.

7. The mixing section of claim 6 wherein the plurality of tabs are disposed in the inlet end of the at least one of the plurality of mixing tube assemblies.

8. The mixing section of claim 6 wherein the plurality of tabs are attached to a retainer ring disposed in the inlet end of the at least one of the plurality of mixing tube assemblies.

9. The mixing section of claim 1 wherein at least one of the turbulators comprises a bluff body.

10. The mixing section of claim 9 wherein each of the bluff bodies is spaced apart from the substantially cylindrical outer wall that substantially surrounds said bluff body.

11. The mixing section of claim 9 wherein each of the bluff bodies is disposed in the inlet end of one of the plurality of the mixing tube assemblies.

12. The mixing section of claim 1 wherein the mixing section further comprises a tube sheet.

13. A mixing section adapted for use in a gaseous burner assembly, said mixing section comprising a plurality of mixing tube assemblies, each of said mixing tube assemblies having an inlet end and an outlet end and comprising:

(a) a substantially cylindrical outer wall, said substantially cylindrical outer wall defining an interior open space and having an inlet end flare;

(b) a turbulator, said turbulator being disposed in the interior open space defined by the substantially cylindrical outer wall and comprising:

(1) a retainer ring, said retainer ring being disposed at the inlet end of the mixing tube assembly;

(2) a plurality of tabs, said plurality of tabs being attached to the retainer ring;

(3) a swirler, said swirler being attached to the plurality of tabs;

(4) a bluff body, said bluff body being attached to the swirler;

wherein each turbulator is substantially surrounded by one substantially cylindrical outer wall and each substantially cylindrical outer wall substantially surrounds one turbulator; and wherein each mixing tube assembly is adapted to receive fuel downstream from the turbulator; and wherein each of the plurality of mixing tube assemblies separately mixes an amount of fuel and air; and wherein the mixing section is adapted to produce a mixture of fuel and air.

14. A method for mixing fuel and air in a burner assembly, said method comprising:

(a) providing a mixing section adapted for use in the burner assembly, said mixing section comprising a plurality of mixing tube assemblies, each of said mixing tube assemblies having an inlet end and an outlet end and comprising:

(1) a substantially cylindrical outer wall, said substantially cylindrical outer wall defining an interior open space;

(2) a turbulator, said turbulator being disposed in the interior open space defined by the substantially cylindrical outer wall, and each of said turbulators comprising:

(i) a retainer ring, said retainer ring being disposed at the inlet end of the mixing tube assembly;

(ii) a plurality of tabs, said plurality of tabs being attached to the retainer ring;

(iii) a swirler, said swirler being attached to the plurality of tabs;

(iv) a bluff body, said bluff body being attached to the swirler;

wherein each turbulator is substantially surrounded by one substantially cylindrical outer wall and each substantially cylindrical outer wall substantially surrounds one turbulator; and wherein each mixing tube assembly is adapted to receive fuel downstream from the turbulator; and wherein each of the plurality of mixing tube assemblies separately mixes an amount of fuel and air;

(b) conveying fuel and air from the inlet end of the mixing tube assembly to the outlet end of the mixing tube assembly.

15. The method of claim 14 further comprising:

(c) mixing gaseous fuel and air in the plurality of mixing tube assemblies.

* * * * *